US010415913B2

(12) United States Patent
Wyssen

(10) Patent No.: US 10,415,913 B2
(45) Date of Patent: Sep. 17, 2019

(54) AMBIDEXTROUS MAGAZINE RELEASE FOR A FIREARM

(71) Applicant: Wyssen Defence AG, Reichenbach (CH)

(72) Inventor: Juerg Wyssen, Reichenbach (CH)

(73) Assignee: Wyssen Defence AG, Reichenbach (CH)

( * ) Notice: Subject to any disclaimer, the term of this patent is extended or adjusted under 35 U.S.C. 154(b) by 0 days.

(21) Appl. No.: 15/808,287

(22) Filed: Nov. 9, 2017

(65) Prior Publication Data

US 2018/0156556 A1 Jun. 7, 2018

(30) Foreign Application Priority Data

Dec. 7, 2016 (CH) ..... 01614/16

(51) Int. Cl.
*F41A 17/38* (2006.01)
*F41A 35/06* (2006.01)

(52) U.S. Cl.
CPC ..... *F41A 17/38* (2013.01); *F41A 35/06* (2013.01)

(58) Field of Classification Search
CPC ..... F41A 17/38; F41A 35/06
USPC ..... 42/6, 7
See application file for complete search history.

(56) References Cited

U.S. PATENT DOCUMENTS 1,397,109 A * 11/1921 Pedersen ..... F41A 3/32 42/7
4,835,892 A * 6/1989 Ruger ..... F41A 35/06 42/7
5,519,954 A 5/1996 Garrett
7,240,600 B1 * 7/2007 Bordson ..... F41A 3/72 42/69.01
8,276,502 B1 * 10/2012 Wright ..... F41A 17/46 42/70.01
2010/0275485 A1 * 11/2010 Findlay ..... F41A 17/36 42/16
2012/0291612 A1 * 11/2012 Kincel ..... F41A 3/72 89/1.4
2015/0323271 A1 * 11/2015 McGinty ..... F41A 35/06 42/17

(Continued)

FOREIGN PATENT DOCUMENTS

WO WO-2005124263 A1 * 12/2005 ..... F41A 17/38

*Primary Examiner* — Bret Hayes
(74) *Attorney, Agent, or Firm* — Volpe and Koenig, P.C.

(57) ABSTRACT

The device (8) allows the release of a detachable magazine from the left and right side of the trigger housing of a firearm, and includes a left lever arm (6) pivotable about a left pivot pin (15) and a right lever arm (7) pivotable about a right pivot pin (14). The right lever arm includes a catch (9) to retain a magazine. The left lever arm (6) includes a left lever extension (12), and the right lever arm (7) includes a right lever extension (13), and these lever extensions are coupled together. When the right lever arm (7), together with its push-button (11), is pivoted to the right, the catch disengages and releases the magazine whilst the left lever arm (6) remains immobile. When the push-button (13) of the left lever arm (6) is pressed to the left, the left lever arm (6) and its left lever extension (12) pivot to the left causing said left lever extension (12) to push the right lever extension (13), and thus the right lever arm (7), to the right, which in turn causes the catch (9) to disengage and release the magazine.

3 Claims, 3 Drawing Sheets

(56) References Cited

U.S. PATENT DOCUMENTS

| | | | | |
|---|---|---|---|---|
| 2017/0122689 | A1* | 5/2017 | Smith | F41A 35/06 |
| 2017/0199000 | A1* | 7/2017 | Paquette | F41A 17/38 |
| 2018/0347925 | A1* | 12/2018 | Gibbens | F41A 3/66 |

* cited by examiner

AMBIDEXTROUS MAGAZINE RELEASE FOR A FIREARM

INCORPORATION BY REFERENCE

The following documents are incorporated herein by reference as if fully set forth: Swiss Patent Application No. 01614/16, filed Dec. 7, 2016.

BACKGROUND

The present invention concerns a device to release a magazine latched into the receiver of a firearm from the left or right side of the firearm.

Known firearm magazines are retained in the receiver by a catch connected to a push-button mechanism. The push-button is located on the right side of the receiver and serves to release the magazine. This placement is ideal for changing magazines for a right-handed user, but it is complicated, inconvenient and disadvantageous for a left-handed user.

SUMMARY

The object of the present invention is therefore to provide means to easily change magazines for both left-handed and right-handed users.

This object is achieved by a device having one or more features of the invention, which preferably comprises a left lever arm and right lever arm, which are coupled by respective lever extensions. Preferred embodiments are disclosed below and in the claims.

BRIEF DESCRIPTION OF THE DRAWINGS

An exemplary embodiment of the device according to the invention is explained in more detail below with reference to purely schematic drawings. The drawings are as follows.

DETAILED DESCRIPTION OF THE PREFERRED EMBODIMENTS

Figure 1:
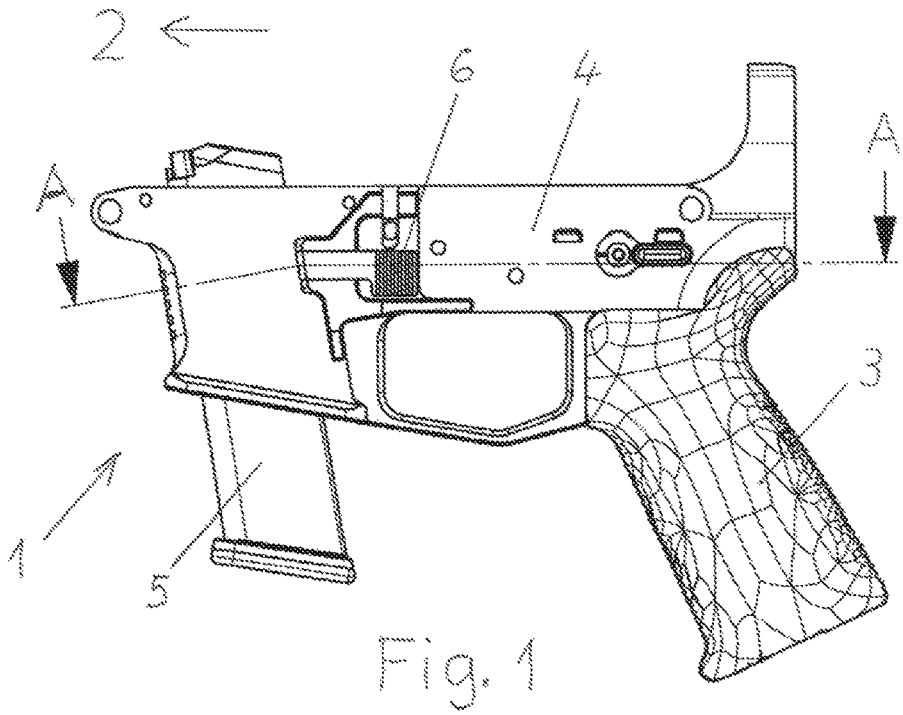
FIG. 1 is a view, from the left, of a firearm receiver with an inserted magazine.
Figure 2:
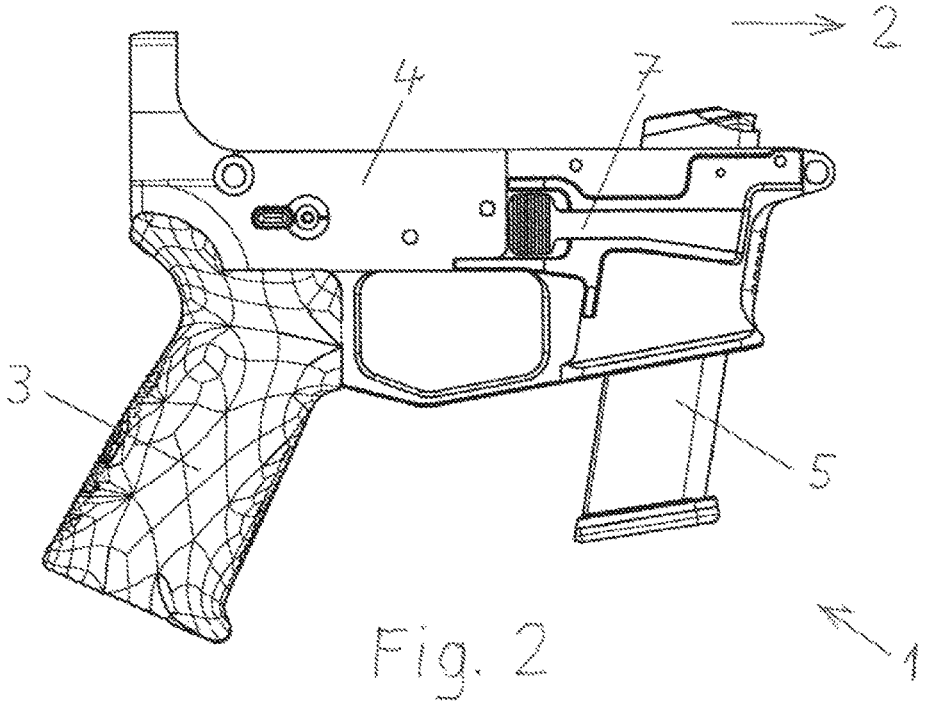
FIG. 2 is a view from the right of the receiver in FIG. 1.

In accordance with FIGS. 1 and 2, the left and right sides of a firearm receiver 1 are shown with a firing direction 2. The receiver 1 includes a pistol grip 3 and a trigger housing 4 with an inserted magazine 5. In FIG. 1, the left lever arm 6 is partially visible and in FIG. 2 the right lever arm 7 is partially visible.

Figure 3:
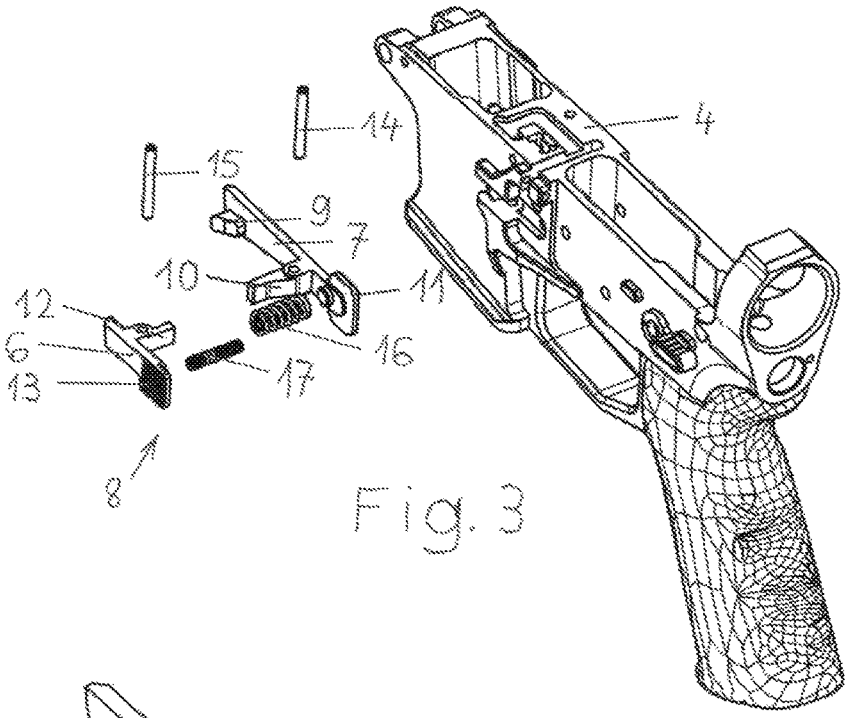
FIG. 3 is a perspective view of the receiver (without magazine) showing the individual component parts of the device.

In FIG. 3, the component parts of the device 8 are shown extracted from the trigger housing 4. The component parts are comprised of a right lever arm 7, which includes: a catch 9 for the magazine, a right lever extension 10, and a push-button 11; and a left lever arm 6 which includes a left extension lever 12, and a push-button 13; as well as a right pivot pin 14, a left pivot pin 15, a strong right spring 16, and a weaker left spring 17.

Figure 4:
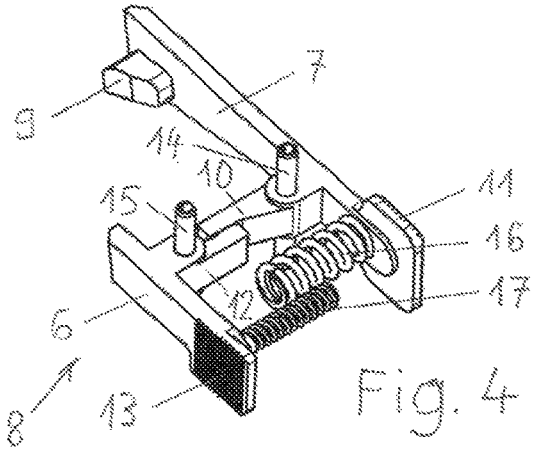
FIG. 4 is a perspective view of the component parts of the device in FIG. 3 in assembled form.
Figure 5:
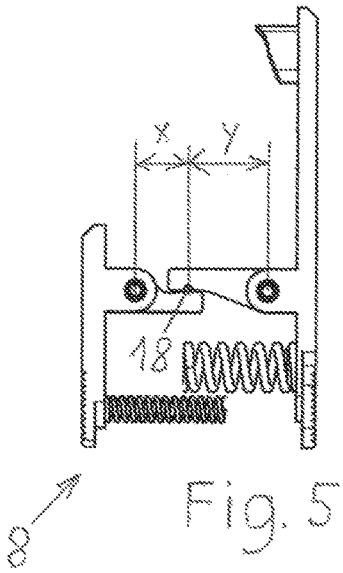
FIG. 5 is a view, from above, of the component parts of FIG. 4.

FIGS. 4 and 5 show the component parts in FIG. 3 in their assembled position, with the omission of the supports for the springs 16 and 17. FIG. 5 shows the distance x, which is the distance between the left pivot pin 15 and the point of contact between the lever extensions 10 and 12, and the distance y, which is the distance between the right pivot pin 14 and the point of contact between the lever extensions 10 and 12. Due to the relative weakness of the left spring 17, a ratio x:y of 2:3 allows the actuation pressure required on the push-buttons 11 and 12 to be the same.

Figure 6:
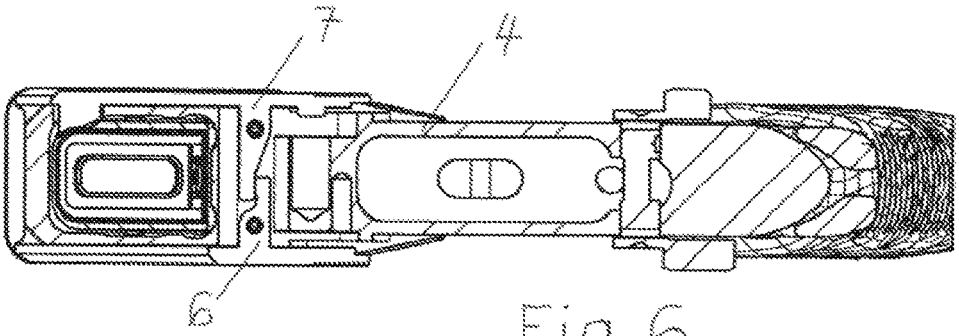
FIG. 6 is a cross-sectional view A-A of FIG. 1, FIGS. 7, 8, and 9 are enlarged views from above of the device components in FIG. 6.
Figure 7:
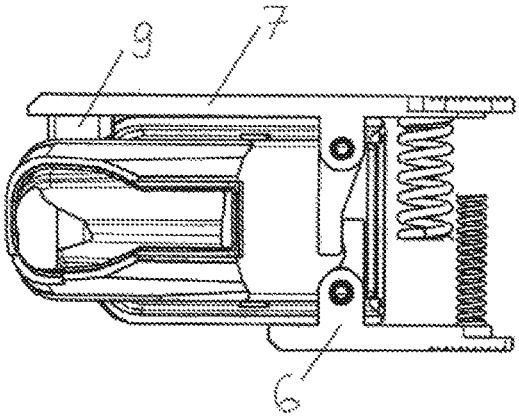
Figure 8:
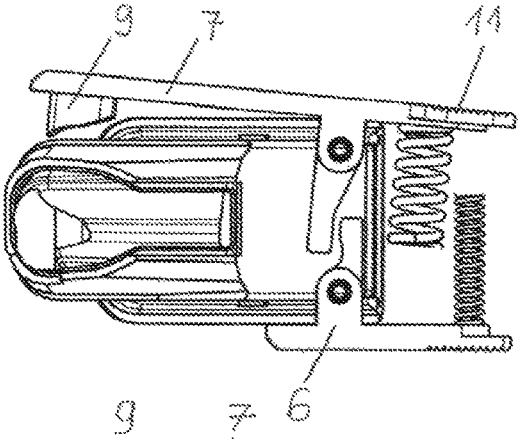
Figure 9:
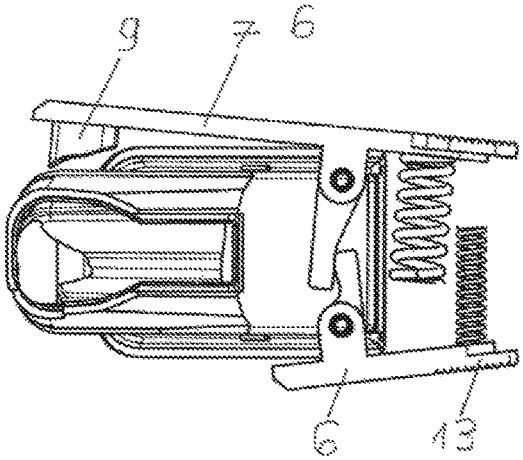

In FIG. 6, the device 8 is shown installed in the trigger housing 4. In FIG. 7, both lever arms 6 and 7 are in a rest position and the magazine is retained by the catch 9. When, as in FIG. 8, the right push-button 11 is pressed, the right lever arm 7 pivots to the right such that the catch 9 releases the magazine. When, as in FIG. 9, the left push-button 13 is pressed, the left lever arm 6 pivots to the left. This causes the left lever extension 12 to press on the right lever extension 10 which in turn causes the right pivoting lever to pivot to the right, again causing the catch 9 to disengage the magazine.

Figure 10:
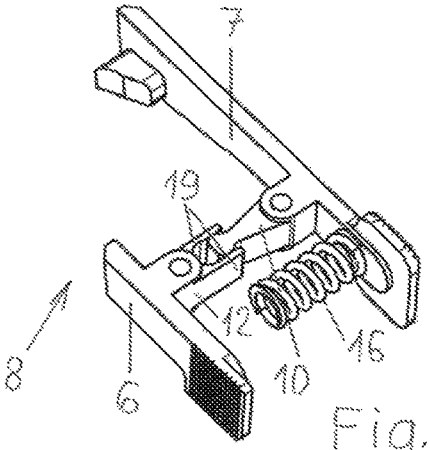
FIG. 10 is a perspective view of a further embodiment of the device.

FIG. 10 shows a variant of the device 8 wherein the left lever extension 12 of the left lever arm 6 includes a fork 19 into which the right lever extension extends, such that pressing the right lever arm 7 to the right to release the magazine also causes the left lever arm 6 to pivot to the left. Pressure on the left lever arm 6 to the left causes the fork 19 to pivot the right lever extension 10, and thus the right lever arm 7 to the right, which moves the catch 9 out of engagement with the magazine. This variant requires only a single spring.

The invention claimed is:

1. A device that is actuatable from left and right sides of a trigger housing of a firearm for releasing a detachable magazine, the device comprising:

a left lever arm and a right lever arm (6, 7) coupled together by respective left and right lever extensions (10, 12);

the left lever extension (12) of the left lever arm (6) ends in a fork that engages the right lever extension such that movement of either of the left or the right lever arms causes movement of the other of the left or right lever arms; and exactly one single spring (16) that acts only on one of the lever arms and returns both the left and the right lever arms to an initial position after release of an actuation force.

2. The device according to claim 1, further comprising a left pivot pin (15) on which the left lever arm (6) pivots, a right pivot pin (14) on which the right lever arm (7) pivots, and a catch (9) on the right lever arm (7).

3. A device that is actuatable from left and right sides of a trigger housing of a firearm for releasing a detachable magazine, the device comprising:

a left lever arm and a right lever arm (6, 7) having different lengths and being coupled together by respective left and right lever extensions (10, 12);

a left pivot pin (15) on which the left lever arm (6) pivots;

a right pivot pin (14) on which the right lever arm (7) pivots;

a catch (9) on the right lever arm (7);

a first spring (17), wherein the left lever arm (6) includes a push button (13) that is biased by the first spring (17);

a second spring (16) having a different spring force than the first spring, and wherein the right lever arm (7) comprises a push button (11) that is biased by the second spring (16); and an actuation force required on the push-buttons (11, 13) is equal due to a length ratio x:y of the left and right lever extensions (10,12).

* * * * *